US007106160B2

(12) United States Patent
Tsergas et al.

(10) Patent No.: US 7,106,160 B2
(45) Date of Patent: Sep. 12, 2006

(54) COIL BOBBIN WITH ANTI-ROTATIONAL ELEMENTS

(75) Inventors: Athanase N. Tsergas, Wood Dale, IL (US); Stoyan Staev, Lombard, IL (US)

(73) Assignee: Molon Motor & Coil Corp., Rolling Meadows, IL (US)

( * ) Notice: Subject to any disclaimer, the term of this patent is extended or adjusted under 35 U.S.C. 154(b) by 23 days.

(21) Appl. No.: 10/923,858

(22) Filed: Aug. 24, 2004

(65) Prior Publication Data

US 2006/0044102 A1 Mar. 2, 2006

(51) Int. Cl.
*H01F 27/29* (2006.01)

(52) U.S. Cl. ..... 336/192; 336/198; 336/208

(58) Field of Classification Search ..... 336/208, 336/192, 198

See application file for complete search history.

(56) References Cited

U.S. PATENT DOCUMENTS 1,612,947 A 1/1927 Schermerhorn
RE16,854 E 1/1928 Schermerhorn
3,068,435 A 12/1962 Oliver, Jr. et al.
3,328,736 A * 6/1967 Keck ..... 336/192
3,605,055 A 9/1971 Grady
4,423,399 A * 12/1983 Goodrich ..... 335/202
5,317,300 A * 5/1994 Boesel ..... 336/96
5,524,334 A * 6/1996 Boesel ..... 29/605
6,691,945 B1 * 2/2004 Slezak ..... 242/564

FOREIGN PATENT DOCUMENTS

GB 2108769 A 5/1983

* cited by examiner

*Primary Examiner*—Anh Mai
(74) *Attorney, Agent, or Firm*—Oblon, Spivak, McClelland, Maier & Neustadt, P.C.

(57) ABSTRACT

A bobbin for an electromagnetic inductive wire coil, to which at least one terminal is attached, has a hollow body with two opposite ends. A side flange is molded integrally to each one of the opposite ends. Each side flange has a plurality of corners and at least one reverse L-shaped rib configuration in at least one corner so that the rib configuration prevents rotation of the bobbin and breaking off of the terminal when a rotational force is applied to the terminal. Another reverse L-shaped rib configuration may be positioned upside down in another corner of each side flange. The reverse L-shaped rib configuration may have a third rib molded integrally thereto to form a reverse C-shaped rib arrangement to confine a rear end of the terminal. This confinement helps to prevent backward movement caused by a head-on force applied to a front end of the terminal.

4 Claims, 3 Drawing Sheets

COIL BOBBIN WITH ANTI-ROTATIONAL ELEMENTS

BACKGROUND OF THE INVENTION

1. Field of the Invention

The invention relates to a bobbin for an electromagnetic inductive coil and in particular to such a coil bobbin used with a ferromagnetic core.

2. Discussion of the Prior Art

As shown in FIG. 1A, there is known a coil bobbin 10 molded from a plastic or resin-type material. At adjacent rounded corners 12 and 14 of the bobbin 10, there is a first electrical contact terminal 16 and a second electrical terminal 18, mounted to the corners 12 and 14, respectively. These terminals 16 and 18 are usually secured by either soldering or rivets or compressed first and second eyelets 20 and 22, also known as grommets.

As seen in FIG. 1B, the first terminal 16 of the bobbin 10 connects via the eyelet 20 to a so-called start wire 24. Returning to FIG. 1A, the start wire 24 is located at a beginning of a wire coil 26 that wraps around a hollow body 28 of the bobbin 10. The coil 26 has located at its end a so-called finish wire 30 which connects via the second eyelet 22 to the second terminal 18.

During the course of a preliminary patentability search for molded plastic or resin-type coil bobbins having terminals secured thereto, exemplary prior art references were located.

For example, U.S. Reissue Pat. No. 16,854 (originally U.S. Pat. No. 1,612,947) was granted on Jan. 17, 1928, to Schermerhorn for a transformer securing electrical terminals 22 thereto via riveted eyelets 21. In particular, see FIGS. 1 and 3 of Schermerhorn.

U.S. Pat. No. 3,068,435 was obtained by Oliver Jr., et al. on Dec. 11, 1962, for an electromagnetic coil having connections 13 to tabs 14 secured by rivets 15 to a bobbin held by a core 18. In particular, see FIGS. 4 and 5 of Oliver Jr., et al.

U.S. Pat. No. 3,605,055 was issued to Grady on Sep. 14, 1971, for a winding bobbin 1 for coils 15[1] and 17[1]. Pockets 20 and 21 support contacts 18 and 19, respectively. In particular, see FIG. 3 of Grady.

U.K. Patent Application No. 2,108,769 of Suzuki was published on May 18, 1983, for an arrangement of electrodes 9 within notched portions (unnumbered) of a flange 6 on a drum (unnumbered) around which a wire coil 10 is wrapped. In particular, see FIG. 5 of Suzuki.

However, in the prior art bobbin 10 illustrated in FIG. 1A, if a rotational force $F_1$ or $F_2$ is applied to either the terminal 16 or the terminal 18 or both, the bobbin 10 will rotate or one of the terminals 16 and 18 will snap off due to breakage at one of the eyelets 20 and 22 or one of two plastic side flanges 32 and 34 will fracture at the corner 12 or 14.

Thus, it remains a problem in the prior art to support securely the terminals attached to the coil bobbin in order to prevent rotation of the bobbin whenever a rotational force is applied to a terminal.

SUMMARY OF THE INVENTION

An electromagnetic inductive coil bobbin has a hollow body with two opposite ends and a side flange molded integrally to each one of the opposite ends. Each side flange has at least one reverse L-shaped rib configuration and a plurality of corners. A pair of electrical contact terminals is mounted on adjacent corners of the side flanges and is prevented by the reverse L-shaped rib configuration from rotating when a force is applied to at least one of the terminals. The reverse L-shaped rib configuration confines a rear end of each terminal against rotation on only two sides. If a third straight rib is added to the reverse L-shaped rib configuration, a reverse C-shaped rib arrangement is formed and is used to confine the rear end of each terminal on three sides.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figures 1A, 1B:
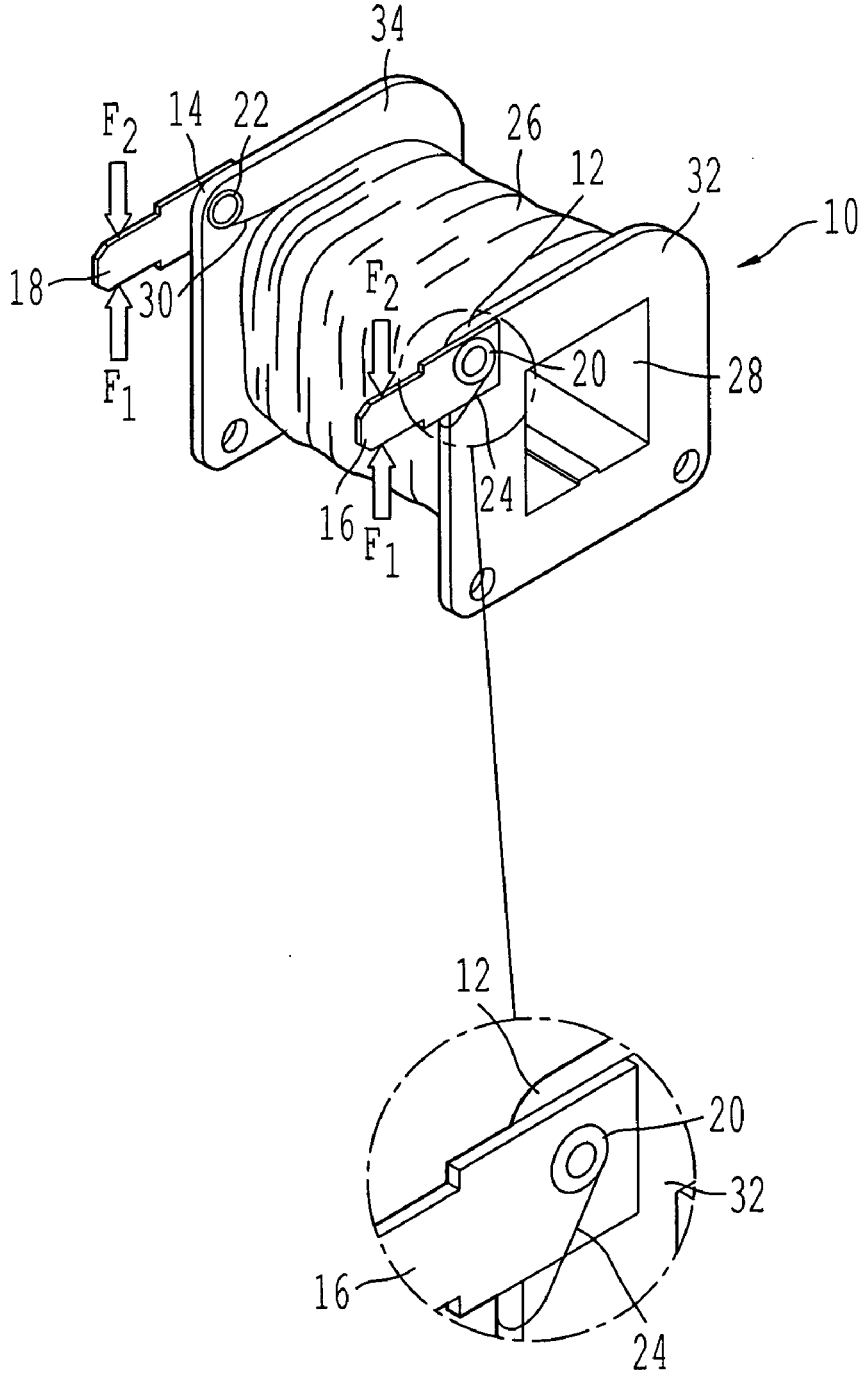
FIG. 1A PRIOR ART
FIG. 1B PRIOR ART
FIG. 1A is a top right front perspective view of a prior art coil bobbin.
FIG. 1B is a detailed and enlarged view of part of one side flange and one terminal illustrated in FIG. 1A.
Figure 2A:
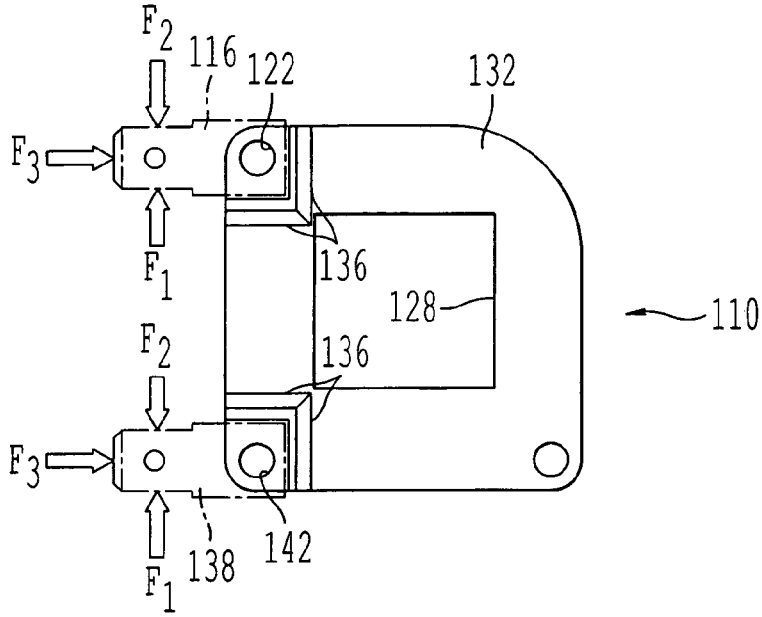
FIG. 2A is a side elevational view of a first embodiment of the invention.

Referring now to the drawings, wherein like reference numerals designate identical or corresponding parts throughout the several views, FIG. 2A is a side elevational view of a first embodiment of the invention. A coil bobbin 110 is molded from a plastic or resin-type material and has a hollow body 128 with a rectangular or square cross section. A side flange 132 has a plurality of rounded corners, preferably four in number. At two corners, there is a pair of ribs 136. An upper pair of ribs 136 forms a reverse L shape. A reverse L shape means an image of a capital letter L that a viewer would see when looking at the letter L in a mirror. A lower optional second pair of ribs 136 forms an upside down L shape. These ribs 136 prevent rotation of the coil bobbin 110 and also prevent breaking off of electrical contact terminals 116 and 138, shown in phantom lines, when a rotational force $F_1$ or $F_2$ is applied thereto. The ribs 136 also prevent breakage of the terminals 116 and 138 when a head-on force $F_3$ is applied thereto. The weak points are eyelets 122 and 142 where the terminals 116 and 138 are attached to the side flange 132 of the coil bobbin 110. Thus, the ribs 136 are added to back up the terminals 116 and 138 against snapping off.

Figure 2B:
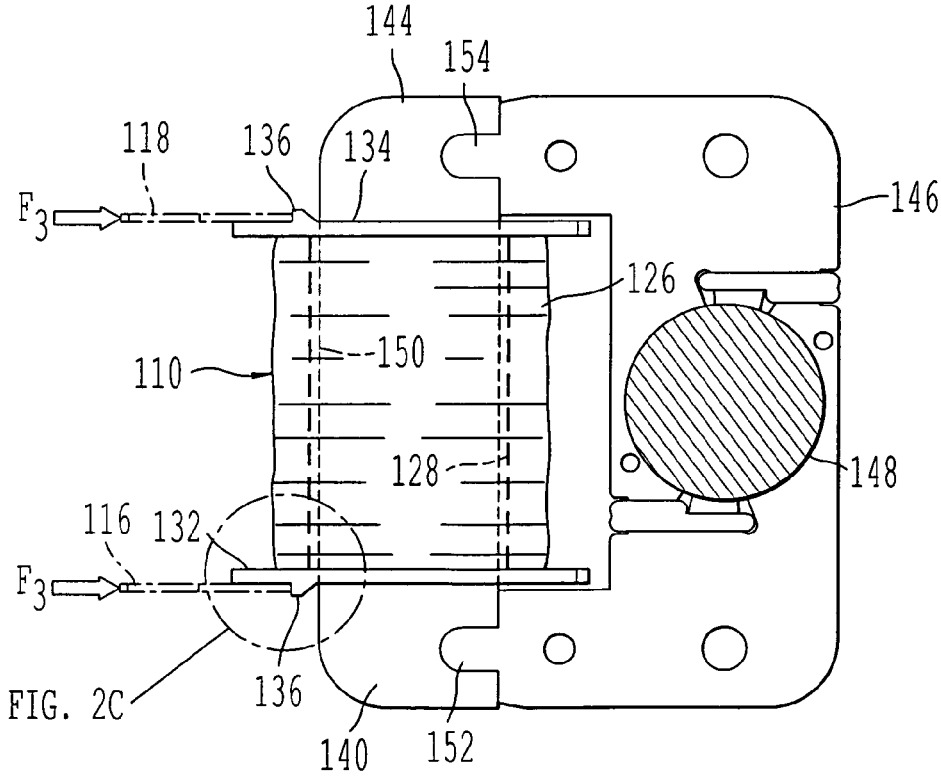
FIG. 2B is a top plan view of the first embodiment in a ferromagnetic core.

In FIG. 2B, there is shown a top plan view of the first embodiment. The bobbin 110 has a wire coil 126 wrapped around the hollow body 128 shown in phantom lines. The bobbin 110 has two plastic side flanges 132 and 134 formed integrally therewith. The bobbin 110 is slid over an iron bar 150 so that the hollow body 128 is filled and only C-shaped ends 140 and 144 of the iron bar 150 protrude from the hollow body 128. Then, the C-shaped ends 140 and 144 of the iron bar 150 are clamped onto protrusions 152 and 154, respectively, of a ferromagnetic stator core 146 to form a closed rectangular loop. Thereafter, the stator core 146 is secured around a cylindrical shaft or rotor 148. Electrical contact terminals 116 and 118, shown in phantom lines, are either soldered or otherwise secured to the side flanges 132 and 134, respectively. The ribs 136 back up and prevent the terminals 116 and 118 from breaking off when a head-on force $F_3$ is applied thereto.

Figure 2C:
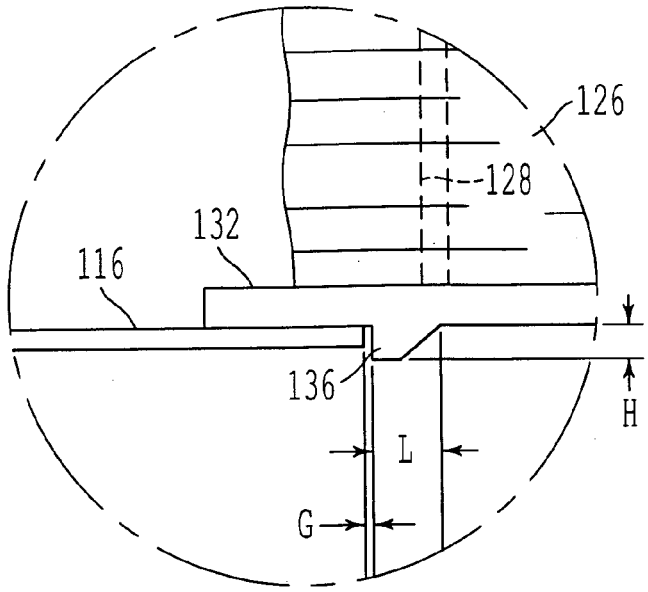
FIG. 2C is a detailed and enlarged top plan view of part of one side flange and one terminal illustrated in FIG. 2B.

In FIG. 2C, there is a detailed and enlarged top plan view of part of the side flange 132 and part of the terminal 116. The wire coil 126 is wrapped around the hollow body 128, shown in phantom lines. Each rib 136 has a length L of 0.1 inch and a height H of 0.05 inch. Note that the rib 136 is molded integrally with the side flange 132. A gap G of 0.01 inch is left between a rear end of the terminal 116 and a front end of the rib 136 to provide a clearance for accumulated tolerances.

Figure 3:
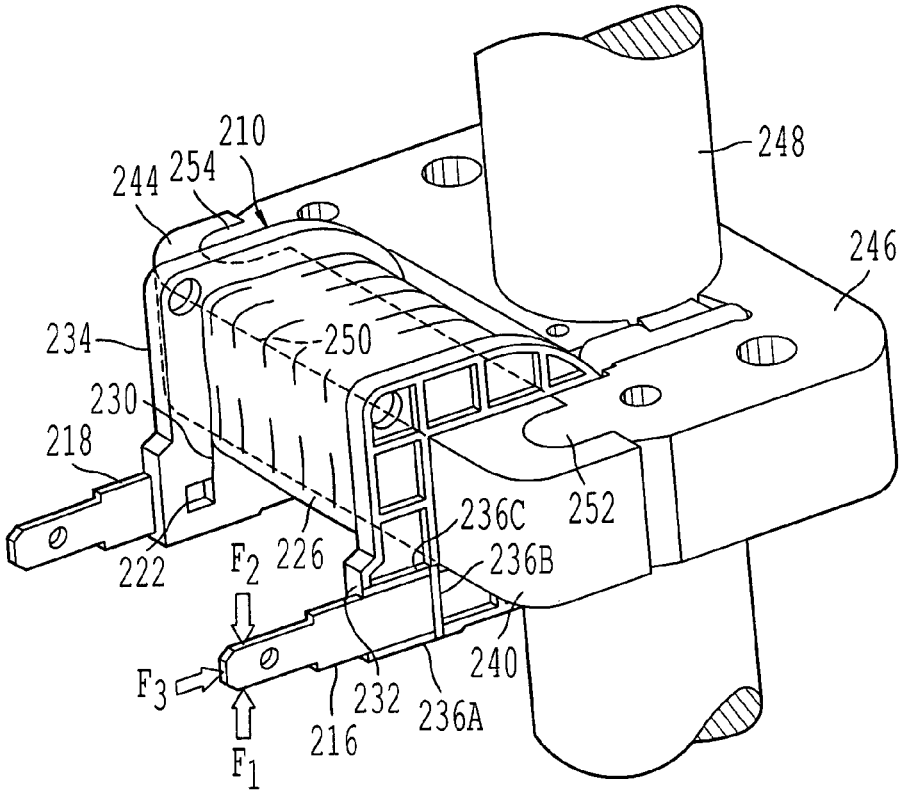
FIG. 3 is a top right front perspective view of a second embodiment held by the ferromagnetic core.

In FIG. 3, a second embodiment of the invention is illustrated. A coil bobbin 210 is slid over an iron bar 250 with C-shaped ends 240 and 244 that clamp over protrusions 252 and 254, respectively, to form a closed loop with a ferromagnetic stator core 246 through which a cylindrical rotor 248 passes perpendicularly. The bobbin 210 includes a wire coil 226 having at its beginning a start wire (not shown) and also having at its end a finish wire 230 which is connected through an opening 222 to an electrical contact terminal 218. The opening 222 may be filled with either solder or a grommet to retain the terminal 218 in place. The bobbin 210 also includes side flanges 232 and 234 which hold terminals 216 and 218, respectively, in place by way of either solder or grommets (not shown) that fill an opening (not shown) in the side flange 232 behind the terminal 216 and the opening 222 in the side flange 234 behind the terminal 218.

The improvement made by the invention is the addition of ribs 236 that support and confine a rear end of each terminal 216 and 218. For example, the ribs 236 in FIG. 3 are molded integrally together with the side flange 232. Ribs 236A and 236B form a reverse L shape. When a third rib 236C is added, these ribs 236A, 236B and 236C form a reverse C shape. A reverse C shape is a mirror image of a capital letter C. Note that ribs 236 do not connect to any type of cover for the rear end of the terminal 216 so that a closed pocket is not formed. Thus, an operator may be able to see what is happening to the terminal 216 where it is connected to the side flange 232.

The inventors have found that either two or three ribs 236 are sufficient to prevent rotation of the coil bobbin 210 when either rotational forces $F_1$ or $F_2$ are applied to the terminal 216. Moreover, the ribs 236 prevent the terminal 216 from breaking away from the side flange 232 of the bobbin 210. Also, the one rib 236B located at the rear end of the terminal 216 is strong enough to prevent backward movement of the terminal 216 when the head-on force $F_3$ is applied to a front end of the terminal 216.

Clearly, numerous modifications and variations of the present invention are possible in light of the above teachings. Therefore, within the scope of the appended claims, the invention may be practiced otherwise than as specifically described herein.

What we claim as our invention is:

1. A bobbin for an electromagnetic inductive wire coil, to which at least one terminal is attached, said bobbin comprising a hollow body with two opposite ends and a side flange molded integrally to each one of the opposite ends, each side flange having a plurality of corners and at least one reverse L-shaped rib configuration in at least one corner so that the rib configuration prevents rotation of the bobbin and breaking off of the terminal by confining a rear end of the terminal when a rotational force is applied to the terminal, wherein the reverse L-shaped rib configuration has another rib molded integrally thereto to form a reverse C-shaped rib arrangement to confine a rear end of another terminal.

2. A bobbin according to claim 1, wherein another reverse L-shaped rib configuration is positioned upside down in another corner of each side flange.

3. A bobbin according to claim 1, wherein the hollow body has one of a rectangular and a square cross section.

4. A bobbin according to claim 1, wherein the reverse C-shaped rib arrangement is coverless.

* * * * *